United States Patent [19]

Moloney

[11] Patent Number: 4,593,658

[45] Date of Patent: Jun. 10, 1986

[54] VALVE OPERATING MECHANISM FOR INTERNAL COMBUSTION AND LIKE-VALVED ENGINES

[76] Inventor: Paul J. Moloney, 33 Malvern Drive, Woodford Green, Essex, England

[21] Appl. No.: 605,922

[22] Filed: May 1, 1984

[51] Int. Cl.[4] ..... F01L 9/04

[52] U.S. Cl. ..... 123/90.11; 123/129.04; 251/131; 310/311

[58] Field of Search ..... 123/90.11, 90.12, 90.13, 123/90.14, 472, 90.27; 310/316, 317; 137/551, 554, 556; 251/130, 131

[56] References Cited

U.S. PATENT DOCUMENTS

| | | | |
|---|---|---|---|
| 3,844,528 | 10/1974 | Massie | 251/30 |
| 3,853,102 | 12/1974 | Myers et al. | 123/90.12 |
| 3,919,989 | 11/1975 | Jarrett et al. | 123/472 |
| 4,009,695 | 3/1977 | Ule | 123/90.13 |
| 4,269,388 | 5/1981 | Seilly et al. | 123/90.11 |
| 4,341,241 | 7/1982 | Baker | 137/554 |
| 4,376,450 | 3/1983 | Fayfield et al. | 251/131 |
| 4,466,390 | 8/1984 | Babitzka et al. | 123/90.12 |

FOREIGN PATENT DOCUMENTS

| | | | |
|---|---|---|---|
| 2133288 | 11/1972 | France . | |
| 2348369 | 11/1977 | France . | |
| 2461097 | 1/1981 | France . | |
| 1240286 | 7/1971 | United Kingdom . | |
| 1391955 | 4/1975 | United Kingdom | 123/90.11 |
| 1395027 | 5/1975 | United Kingdom . | |
| 1410312 | 10/1975 | United Kingdom . | |
| 1464294 | 2/1977 | United Kingdom . | |
| 1569638 | 6/1980 | United Kingdom . | |
| 2058992 | 4/1981 | United Kingdom . | |
| 2087660 | 5/1982 | United Kingdom . | |

OTHER PUBLICATIONS

Proceedings of the National Conference of Fluid Power, vol. 27, 29th Annual Meeting, Sep. 25–27, 1973, Chicago, Ill. (US), C. G. O'Neill et al.: "Piezoelectric Drivers for Fluid Power Control", pp. 167–183.

*Primary Examiner*—Craig R. Feinberg
*Assistant Examiner*—David A. Okonsky
*Attorney, Agent, or Firm*—Parkhurst & Oliff

[57] ABSTRACT

A valve operating mechanism for an internal combustion or like valved engine comprises a piezo-electric control device arranged to control the operating movement of an engine valve in accordance with the extension of the control device and control means for controlling the electrical feed to the piezo-electric device in accordance with parameters of the engine operation fed to it.

16 Claims, 3 Drawing Figures

VALVE OPERATING MECHANISM FOR INTERNAL COMBUSTION AND LIKE-VALVED ENGINES

BACKGROUND OF THE INVENTION

This invention relates to a valve operating mechanism for internal combustion and like-valved engines.

It has for some time been realized that the requirements for engine valve timing in an internal combustion engine are variable depending upon the speed of the engine when optimum operation is desired. Thus in the use of the usual mechanically operated valve system, operated by means of a camshaft, selection is dependent upon the maximum engine power at high speed operation, minimum exhaust emissions at low speed part-load operation, or on some form of compromise between the two. Considerable research has been undertaken on this subject which have largely produced the conclusion that, ideally, full control over every parameter of valve movement is required; and these parameters need to be varied in response to the operating conditions of the engine at any particular time. As a result of this research, various modifications have been proposed for existing camshaft installations, and in different ways in dependence upon the particular objectives which have been considered in the particular research involved. Nevertheless, no modification has been found which is capable of providing a full optimum control of the valve operation over the whole of the operating conditions of the engine, and, as a result, any proposed system is effectively only a compromise.

SUMMARY OF THE INVENTION

It is an object of the present invention to provide a valve operating mechanism for an internal combustion, or like-valved engine in which the operating mechanism enables a substantially full control to be exercised over all parameters for each of the valves of the engine.

According to the invention, there is provided a valve operating mechanism for an internal combustion engine or like valved engine comprising a piezo-electric control device arranged to drive an engine valve in accordance with the extension of said piezo-electric control device, and control means to control an electrical feed to said piezo-electric control device in accordance with parameters of engine operation fed to it.

BRIEF DESCRIPTION OF THE DRAWINGS

The invention will now be described in greater detail, by way of example, with reference to the drawings, in which.

DESCRIPTION OF THE PREFERRED EMBODIMENTS

Figure 1:
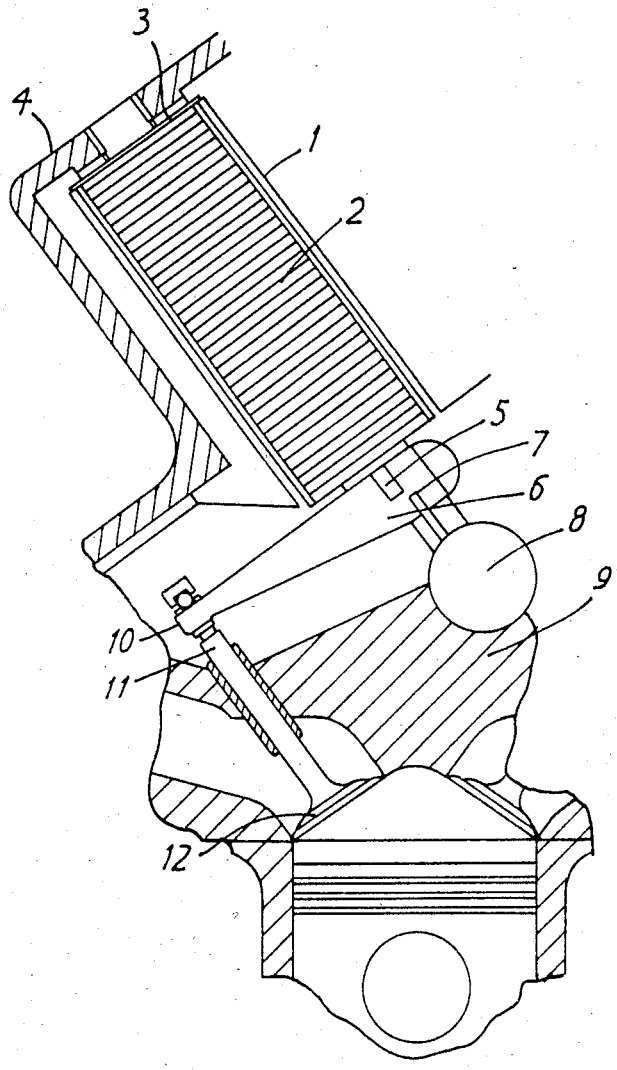
FIG. 1 is a diagrammatic view of a value operating mechanism in accordance with the invention, with mechanical linkage between the piezo-electric device, and the valve.

Referring firstly to FIG. 1, there is shown a mechanical version of the valve operating mechanism. In this figure, the piezo-electric device is indicated as I and comprises a stack of piezo-electric discs or rings 2 to which a voltage can be applied by a means not shown. One end of the stack of discs or rings 2 is fixedly mounted at 3 in a housing 4 while the other end of the stack is freely movable. At this end of the stack, there is provided an operating pin 5 which engages an operating lever arm 6 pivoted at 7 and carried by a carrier 8 mounted on the engine block 9. This lever arm 6 is connected at 10 to the actuating rod 11 of the valve 12. As will be seen, the relatively small movement of the piezo-electric device 1 is converted by the lever arm 6 into a considerably larger movement for actuating the valve 12.

In this embodiment, the voltage supplied to the piezoelectric devices acts by direct mechanical linkage on the valve 12, and the valve 12 will move thus in accordance with the voltage supply to the piezoelectric device 1. While in this embodiment no motion sensor has been provided for clarity, in order to enable operation with a feedback loop, a suitable sensor would be mounted to sense the movement of the valve.

Figure 2:
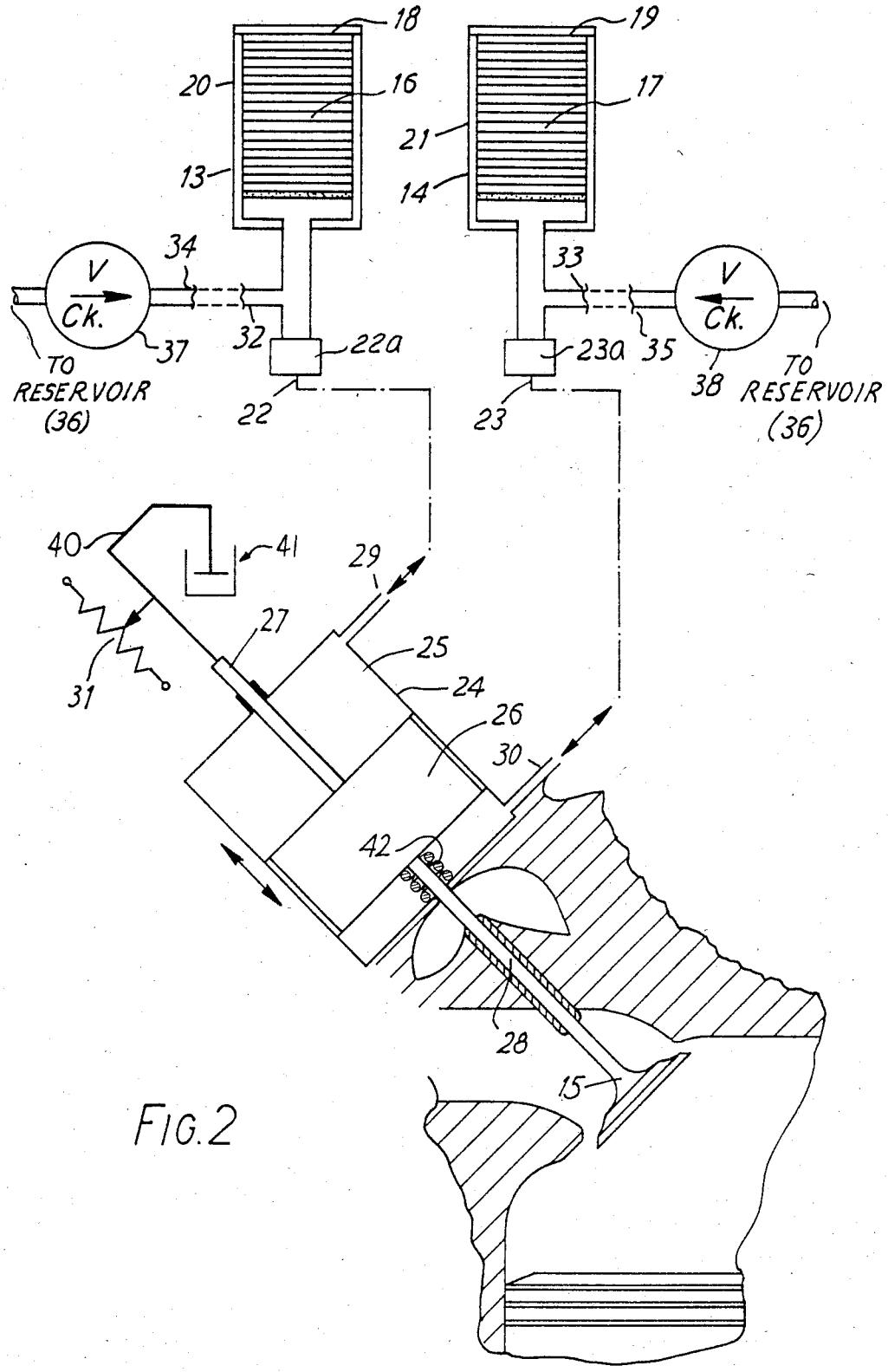
FIG. 2 is a diagrammatic view of a valve operating mechanism in accordance with the invention, in which two piezo-electric devices act as fluid/gas pumps.

FIG. 2 shows a second form of the invention, where two piezo-electric devices, 13 and 14, generate and control the pressure of the fluid/gas, and hence control the movement of the valve 15 of an internal combustion engine. The two piezo-electric devices suitably comprise a number of piezo-electric discs or rings, 16 and 17, to which a voltage can be applied by a means not shown. One end of the stack of discs or rings, 16, 17 is fixedly mounted at 18, 19 in a housing 20, 21, while the other ends of the stacks are freely movable. Where rings are used, the free ends could be attached to a bolt which passes through the stack from one end to the other. At these ends of the stacks, there are connections 22, 23, which lead, through valves **22*a* and 22*b* operated by any derived means and controlled by the operating system to a control ram 24, for actuating the valve 15. This ram comprises a cylinder 25 in which lie the piston 26 carried by a rod 27 which is suitably an extension of the rod 28 of the valve 15. Connections 29, 30, are provided which are connected to the connections 22, 23, respectively, and provide for the feed or exhaust of fluid/gas from either side of the piston 26. The end of the rod 27 is suitably provided with a motion sensor, indicated schematically in the variable resistor 31. The system can be closed in that the same fluid/gas is used repeatedly, and connections 32, 33 are not needed, or, alternatively, connections 32, 33 can lead to connections 34, 35 through which extra fluid/gas can be supplied from the reservoir 36 under the control of the one-way valves 37, 38**. These one-way valves could be controlled electrically or mechanically, by a means not shown. The reservoir could be pressurised, if required.

In operation, voltages are applied to the stacks of piezo-electric discs or rings 16, 17, (the magnitude and form of the voltage depending upon the required parameters of valve movement of the valve 15). This voltage can be converted into an expanding longitudinal movement of one or more 'strokes' so as to feed fluid/gas under pressure to one side of the control ram 24. Alternatively, the voltage can be converted to a contracting longitudinal movement of one or more 'strokes' so as to control the flow of fluid/gas being exhausted from the control ram 24. Thus the actuating piston 26 will be moved longitudinally in the cylinder 25 in response to the voltages applied to the piezoelectric devices 13 and 14, and will open and close the valve in a controlled way. Feedback of the movement carried out is provided by the movement sensing device 31, and this information is fed back to control apparatus, as will be seen hereafter, in order to provide a control loop for control of the piezoelectric devices 13 and 14.

In some circumstances, particularly in these embodiments, it may be desirable to provide a damper for the operation of the engine valve. This could take the form of a piston 40 and dashpot 41 connected to the end of the valve operating rod, suitably at the position indicated for the motion sensor. The motion sensor could then be suitably relocated.

Figure 3:
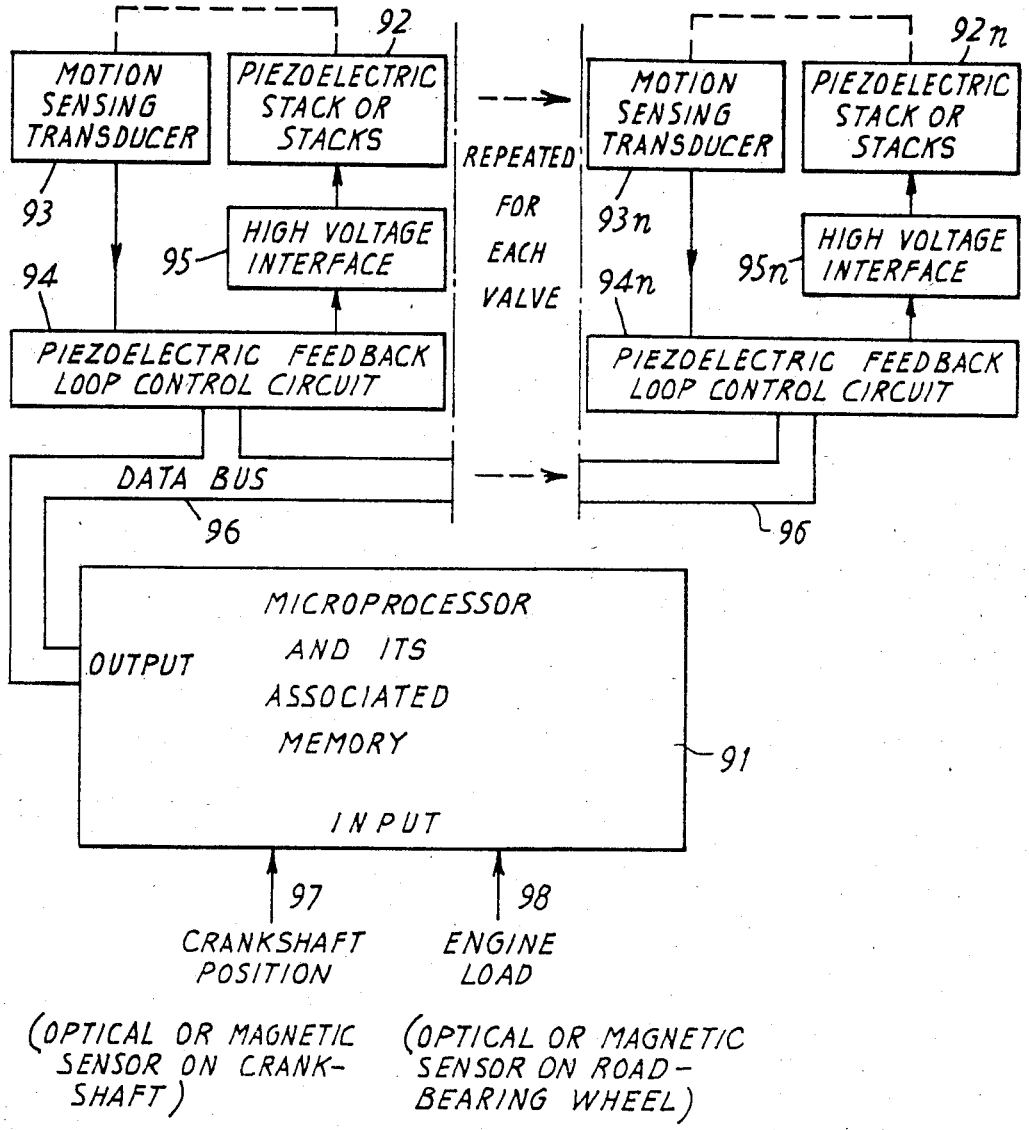
FIG. 3 is a block circuit diagram showing a typical proposal for the circuitry of the control means for control of the piezo-electric devices as shown in FIGS. 1 and 2.

FIG. 3 is a block diagram of a suitable electronic control arrangement for operating the valves of an internal combustion engine, and provide for control of the piezo-electric devices as shown in FIGS. 1 and 2. In the arrangement of FIG. 3, all the valves of an internal combustion engine are to be controlled by a single microprocessor or computer and its associated memory indicated at 91. In this figure, two groups of piezo-electric control devices are shown, indicated 92 and 92*n*, each group having one, (see FIGS. 1 & 3), or two, (see FIG. 2), piezo-electric devices associated with one motion sensing transducer, 93 and 93*n*, which feeds information into a piezo-electric feedback loop control circuit, 94 and 94*n*.

The loop control circuit 94 and 94*n* provides a signal to a high-voltage interface, 95, 95*n*, which feeds its associated group of piezo-electric devices, 92, 92*n*. This part of the circuit provides for a loop control system so that the movement transmitted by the piezoelectric device(s) to the valve is sensed and any deviation from the correct movement is corrected by means of the control circuit. In addition to this loop, instructions are also fed into the piezo-electric feed-back loop control circuit, 94, 94*n*, by way of a data bus 96, which transmits instructions from the microprocessor and its associated memory 91, to the control circuit. The microprocessor unit is fed with the necessary input data providing information as to the operational state of the engine. In the particular example shown, this informaton is provided at two inputs 97 and 98.

The input 97 is provided with a value indicating the crankshaft position, which may be detected by an optical or magnetic sensor. The input 98 is provided with values representing the engine load, and can be determined by an optical or magnetic sensor on a roadbearing wheel. Other information which can be included in the information presented to the microprocessor include crankshaft position, engine speed, mixture information, inlet conditions, and exhaust conditions.

The microprocessor or computer is programmed to convert the information which is provided by its inputs, 97 and 98, into instructions which indicate the optimal operation of the valve in question. These instructions modify the loop control circuit of the individual piezo-electric devices, 92 and 92*n*, so that optimum operation of the valves results. Thus the processor output data may represent timing, lift position and velocity profile for the operation of the associated valves.

Additional functions of the microprocessor or computer can control the valve to provide a number of different effects. Firstly, admitted fuel-air mixture could be increased so as to make starting of the engine easier. Secondly, the engine could be used as a brake by causing the inlet valves to remain shut during intake strokes of the engine, and in this way cause an increase in deceleration of the vehicle to which it is connected. Thirdly, the lift of the inlet valve can be varied in such a fashion as to increase the pressure drop at the intake port. In this way, the velocity in Reynolds Number of the incoming mixture can be increased. Thus, the thermal efficiency of the engine can be increased, and it is possible to use very lean fuel-air ratios where there is only a part-load. It is also possible to dispense with, entirely, the carburettor butterfly, and rely entirely on valve control. This piezo-electric valve operating system can also easily cope with the extra demands of a turbocharger-supercharger installation; and in the hydraulic mode of the system, can provide valuable cooling to help cope with the increased heat generated.

Considering the construction of the piezo-electric stack itself, a typical piezo-electric material which would be suitable, is that known as PXE5 manufactured by Phillips, which provides an extension of $616\times10^{-12}$ meters/volt. If a construction of 1 to 200 discs were used, each disc say 10 mm diameter, and over 5 mm thick, adequate operation will be provided for the hydraulic system outlined in FIG. 2. For the mechanical arrangement such as shown in FIG. 1, an even more responsive piezo-electric device would be needed, to obviate the necessity of having an over large mechanical ratio.

In a typical situation, an operating voltage of between 500 and 2000 volts could be used. The current supply into the piezo-electric device would be of the order of milliamps, the power needed for driving the piezoelectric devices of an eight cylinder engine for example, would be very approximately the order of 1 H.P.

It will be appreciated that various modifications may be made to the above described embodiments without departing from the scope of the invention. For example, the loop control circuit could be omitted, only direct control of the piezo-electric device being provided. The hydraulic control could be replaced by a simple pneumatic control. Instead of providing a double-acting ram for the actual operation of the valve, this could be replaced by a single-acting ram with a return spring 42 (shown in dashed lines in FIG. 2). Where the hydraulic control is used, the hydraulic control apparatus could all be housed together at a position spaced from the actuating cylinders of the valves, so that in this way a single control function limit is formed.

From the above described embodiment, it will be seen that there is provided a valve operating mechanism which, with sufficient control functions, can control the operation of the valves of an internal combustion engine in respect of all their parameters of movement.

It will be understood that the above description of the present invention is susceptible to various modifications, changes and adaptations.

What is claimed is:

1. A valve operating mechanism for an internal combustion engine comprising a piezo-electric actuating device arranged to drive an engine valve opening directly into a combustion chamber by the expansion of said piezo-electric actuating device such that expansion of said piezo-electric actuating device provides the sole motive force for opening said valve and control means to control an electrical feed to said piezo-electric actuating device in accordance with parameters of engine operation fed to it.

2. A mechanism as defined in claim 1, and comprising a fluid linkage including an hydraulic or pneumatic piston and cylinder arrangement directly driving said engine valve and to which said piezo-electric actuating device is connected.

3. A mechanism as defined in claim 1 and comprising a return spring for said engine valve.

4. A mechanism as defined in claim 1, and comprising a first piezo-electric actuating device for driving said engine valve in an opening direction and a second piezo-electric actuating device for driving said engine valve in a closing direction.

5. A mechanism as defined in claim 1, wherein said piezo-electric actuating device comprises a stack of individual piezo-electric elements.

6. A mechanism as defined in claim 1 and comprising a motion sensor to provide feedback for control of the piezo-electric actuating device and fitted to said engine valve.

7. A mechanism as defined in claim 1, and comprising an amplifying mechanical linkage coupling said piezo-electric actuating device to said engine valve.

8. A mechanism as defined in claim 7, wherein said amplifying mechanical linkage comprises a lever arm pivoted at one end and acting on the engine valve at the other end, and an operating means in said piezo-electric actuating device engageable with said lever arm close to its said pivot.

9. A mechanism as defined in claim 1 wherein said control means includes a microprocessor or computer to which data on the operation of said engine are fed.

10. A mechanism as defined in claim 9, wherein said microprocessor or computer is fed with the position of the crankshaft of said engine and the load of said engine.

11. A valve operating mechanism for an internal combustion engine comprising:

a plurality of engine valves opening directly into at least one combustion chamber;

a lever for controlling each said valve, each lever being pivotally mounted to said engine and being attached to the corresponding valve to control the valve at a position remote from said pivot;

a piezo-electric actuating device for each valve, each piezo-electric actuating device being drivingly connected to the corresponding lever at a point near the pivot of said lever, the expansion of each piezo-electric actuating device actuating the corresponding valve by moving the corresponding lever, such that expansion of each piezo-electric actuating device provides the sole motive force for actuating the corresponding valve; and control means for controlling the expansion of said piezo-electric actuating devices in accordance with parameters of engine operation fed to said control means.

12. The valve operating mechanism as described in claim 11, wherein said control means comprises a microprocessor to which data on the operation of said engine are fed, and which is programmed to control the position of said piezo-electric actuating devices based on said data.

13. A valve operating mechanism for an internal combustion engine or like valved engine comprising:

a plurality of engine valves, each valve being movable by a corresponding rod connected to a corresponding hydraulically or pneumatically actuated piston, with a fluid-tight cylinder surrounding each said piston;

a first piezo-electric actuating device for each valve for pressing fluid into said fluid-tight chamber to drive the corresponding piston to open said valve;

a second piezo-electric actuating device for each valve for pressing fluid into said fluid-tight chamber to drive the corresponding piston to close said valve; and control means for controlling said first and second piezo-electric actuating devices in accordance with parameters of engine operation fed to said control means.

14. A mechanism as defined in claim 13, wherein said control means comprises a microprocessor to which data on the operation of said engine are fed, and which is programmed to control said first and second piezo-electric control devices based on said data.

15. A mechanism as defined in claim 13 further comprising at least one motion sensor connected to at least one of said engine valve rods for sensing a position thereof.

16. A mechanism as defined in claim 13 further comprising at least one dashpot connected to at least one of said engine valve rods for damping vibrational motion thereof.

* * * * *